US011821610B2

(12) United States Patent
Cao et al.

(10) Patent No.: US 11,821,610 B2
(45) Date of Patent: Nov. 21, 2023

(54) LIGHT-EMITTING DEVICE WITH RIB BETWEEN INNER AND OUTER COVER PORTIONS

(71) Applicant: Panasonic Ecology Systems Guangdong Co., Ltd., Guangdong (CN)

(72) Inventors: Zhanxiong Cao, Guangdong (CN); Haozhou Chen, Guangdong (CN); Yingying Wen, Guangdong (CN)

(73) Assignee: Panasonic Ecology Systems Guangdong Co., Ltd., Guangdong (CN)

( * ) Notice: Subject to any disclaimer, the term of this patent is extended or adjusted under 35 U.S.C. 154(b) by 0 days.

(21) Appl. No.: 17/925,473

(22) PCT Filed: May 25, 2021

(86) PCT No.: PCT/CN2021/095633
§ 371 (c)(1),
(2) Date: Nov. 15, 2022

(87) PCT Pub. No.: WO2022/001488
PCT Pub. Date: Jan. 6, 2022

(65) Prior Publication Data

US 2023/0184410 A1 Jun. 15, 2023

(30) Foreign Application Priority Data

Jun. 30, 2020 (CN) ..... 202021250393.9

(51) Int. Cl.
*F21V 15/01* (2006.01)
*F21V 3/00* (2015.01)

(52) U.S. Cl.
CPC ..... *F21V 15/01* (2013.01); *F21V 3/00* (2013.01)

(58) Field of Classification Search
CPC . F21V 15/01; F21V 3/02; F21V 11/08; F21V 11/06; H01H 13/023
See application file for complete search history.

(56) References Cited

U.S. PATENT DOCUMENTS 2,398,624 A * 4/1946 Decker ..... F21V 13/02 362/342
4,882,662 A * 11/1989 Prodell ..... F21V 11/06 362/291

(Continued)

FOREIGN PATENT DOCUMENTS

CN 201199000 Y 2/2009
CN 207122858 U 3/2018

(Continued)

OTHER PUBLICATIONS

International Search Report and Written Opinion issued in PCT/CN2021/095633, dated Jul. 29, 2021, 9 pages (with partial English Translation).

*Primary Examiner* — Ismael Negron
(74) *Attorney, Agent, or Firm* — RatnerPrestia

(57) ABSTRACT

A light-emitting device including a casing with a light-transmitting port; a light source disposed inside the casing; and a casing cover disposed in the light-transmitting port. The casing cover having an outer peripheral cover portion with an opening; an inner peripheral cover portion located in the opening; a light-transmitting gap formed between the inner peripheral cover portion with the outer peripheral cover portion; and a connecting rib spanning the light-transmitting gap to connect the outer peripheral cover portion with the inner peripheral cover portion. The connecting rib includes a concave portion extending toward an inside of the casing and configured to allow light from the light source to pass through.

7 Claims, 9 Drawing Sheets

(56) References Cited

U.S. PATENT DOCUMENTS

| | | | | |
|---|---|---|---|---|
| 5,373,431 | A * | 12/1994 | Hayman | F21V 21/04 362/345 |
| 5,820,247 | A * | 10/1998 | Schuler | F21V 33/0088 362/147 |
| 6,705,747 | B2 * | 3/2004 | Caferro | F21V 13/10 362/147 |
| 8,911,106 | B2 * | 12/2014 | Sato | F21S 8/061 362/241 |
| 9,930,444 | B1 * | 3/2018 | Stanley | H04R 5/02 |
| 10,068,722 | B2 * | 9/2018 | Luo | H01H 13/023 |
| 10,240,954 | B2 * | 3/2019 | Arceo | F21V 11/12 |
| 11,118,745 | B2 * | 9/2021 | Zheng | F21V 21/30 |
| 11,287,094 | B2 * | 3/2022 | Zheng | F21V 33/0056 |
| 11,346,542 | B2 * | 5/2022 | Keresztes | F21V 23/0485 |
| 2014/0177230 | A1 * | 6/2014 | Rea | F21V 11/06 362/304 |

FOREIGN PATENT DOCUMENTS

| | | | |
|---|---|---|---|
| CN | 208299954 | U | 12/2018 |
| CN | 210347600 | U | 4/2020 |
| CN | 212408339 | U | 1/2021 |
| JP | 2020047391 | A | 3/2020 |

* cited by examiner

FIG. 1-Prior Art

LIGHT-EMITTING DEVICE WITH RIB BETWEEN INNER AND OUTER COVER PORTIONS

CROSS REFERENCE TO RELATED APPLICATIONS

This application is a U.S. National Phase Application of PCT International Application No. PCT/CN2021/095633, filed on May 25, 2021, which claims priority to Chinese Patent Application No. 202021250393.9, filed on Jun. 30, 2020, incorporated herein by reference in their entirety.

TECHNICAL FIELD OF THE INVENTION

The present disclosure relates to a field of a display lamp technology, and in particular, to a light-emitting device.

BACKGROUND OF THE INVENTION

Display lamps are generally provided in today's various electrical products. The display lamps may not only improve an appearance design of a product, but also prompt a user with information such as an operating status of the product by means of light color, flickering and the like. For example, an ambient air quality detection device mentioned in Chinese Patent Application No. CN201921131625.6, issued as Chinese Patent No. CN210347600U, incorporated herein by reference, is provided with a display lamp structure. Referring to FIG. 1, the display lamp structure mainly includes an outer casing 4, a combined end cover 5, a touch control block 7 and a breathing lamp 8; the combined end cover 5 is disposed on a top portion of the outer casing 4, the touch control block 7 is disposed on an outer surface of the combined end cover 5, and the breathing lamp 8 is disposed around the touch control block 7. The breathing lamp 8 includes a ring-shaped light-transmitting plate and a plurality of light sources disposed below the ring-shaped light-transmitting plate, and the plurality of light sources emit light and irradiate the ring-shaped light-transmitting plate above the light sources to display light. However, in order to save a material of the ring-shaped light-transmitting plate to thereby reducing a cost, a gap is generally provided between the ring-shaped light-transmitting plate and the touch control block 7 in a center of the ring-shaped light-transmitting plate in the related art. At the same time, a connecting component is disposed between the touch control block 7 and the combined end cover 5 to support the touch control block 7 to thereby fixing the touch control block 7 on the combined end cover 5. However, when light emitted by the light sources is irradiated on the connecting component, a part of the light emitted from a lower portion of the connecting component may be blocked by the connecting component, so that a light path displayed in the ring-shaped light-transmitting plate is discontinuous and incomplete, causing the user to feel unpleasant or mistakenly believe that the product is defective.

In order to solve the above-mentioned problem, the present disclosure provides a light-emitting device that may prevent the light emitted by the light sources from being blocked so as to prevent the displayed light path from being discontinuous and incomplete.

SUMMARY OF THE INVENTION

Based on this, an object of the present disclosure is to overcome deficiencies of the related art and provide a light-emitting device which, through an ingenious structural design, may prevent light emitted by a light source from being blocked by a connecting component, thereby ensuring an integrity of a light path.

The present disclosure is achieved through the following technical solutions: a light-emitting device, including: a casing provided with a light-transmitting port; a light source disposed inside the casing; and a casing cover covering the light source, wherein the casing cover is configured to be disposed in the light-transmitting port to cover the casing; wherein the casing cover includes: an outer peripheral cover portion provided with an opening; an inner peripheral cover portion located in the opening, wherein a light-transmitting gap is formed by spacing the inner peripheral cover portion with the outer peripheral cover portion; and a connecting rib configured to span the light-transmitting gap, and connect the outer peripheral cover portion with the inner peripheral cover portion; wherein the connecting rib includes a concave portion toward an inside of the casing and configured to prevent at least a portion of light emitted by the light source from being blocked by the connecting rib.

Compared with the related art, the present disclosure provides a light-emitting device in which the connecting rib spanning the light-transmitting gap is designed with a concave portion extending toward the inside of the casing, so that the light emitted by the light source is not blocked by the connecting rib and may pass through the concave portion obliquely and be irradiated to the light-transmitting gap located above the connecting rib, thereby ensuring a formation of a complete light path in the light-transmitting gap, thus improving an appearance and an use of a product.

Further, the concave portion includes: two concave portion extending surfaces opposite to each other and configured to respectively extend from two side edges of the light-transmitting gap to the light source, and a concave portion bottom surface close to the light source and configured to connect the two concave portion extending surfaces. The two concave portion extending surfaces and the concave portion bottom surface together form the concave portion, so that the light emitted from the light source may be obliquely irradiated to the light-transmitting gap located above the connecting rib, thereby preventing the formation of a vacancy in a light path due to an absence of irradiation here.

Further, a distance between the concave portion extending surfaces is greater than or equal to a width of the light-transmitting gap. If the distance between the two concave portion extending surfaces is less than a distance of the light-transmitting gap, it is difficult for the light emitted by the light source to fulfill the light-transmitting gap. Therefore, the distance between the two concave portion extending surfaces is set to be greater than or equal to the width of the light-transmitting gap, thereby ensuring a complete light path of the light-transmitting gap, and preventing the user from feeling unpleasant or mistakenly believing that the product is defective due to an incomplete light path.

Further, the light source is a plurality of lamp beads, and the lamp beads are located below the connecting rib and are staggered with the connecting rib. If the lamp bead is disposed directly below the connecting rib, the light emitted from the lamp bead will be blocked by the connecting rib anyway and thus may not be irradiated to the light-transmitting gap located above the connecting rib. Therefore, in the present disclosure, the lamp bead is staggered with the connecting rib.

Further, the casing cover further includes: a supporting shaft disposed inside the casing, wherein one end of the supporting shaft is fixed on the inner peripheral cover portion, and the other end of the supporting shaft abuts against the casing in a state of the casing cover covering the casing. The supporting shaft is used to support the inner peripheral cover portion to thereby prevent the inner peripheral cover portion from falling or detached when being subjected to a pressure.

Further, the casing cover further includes: a first reinforcement rib protruding in a direction from a bottom surface of the inner peripheral cover portion to the light source, wherein the first reinforcement rib is configured to connect the connecting rib with the supporting shaft. The first reinforcement rib may further enhance a strength of the inner peripheral cover portion, preventing the inner peripheral cover portion from being damaged when being subjected to a pressure.

Further, the casing cover further includes: a second reinforcement rib protruding in the direction from the bottom surface of the inner peripheral cover portion to the light source, wherein the second reinforcement rib is configured to intersect with the first reinforcement rib. The second reinforcement rib may enhance the strength of the inner peripheral cover portion together with the first reinforcement rib, preventing the inner peripheral cover portion from being damaged when being subjected to a pressure.

For better understanding and implementation, the present disclosure will be described in detail below with reference to the accompanying drawings.

Figure 1:
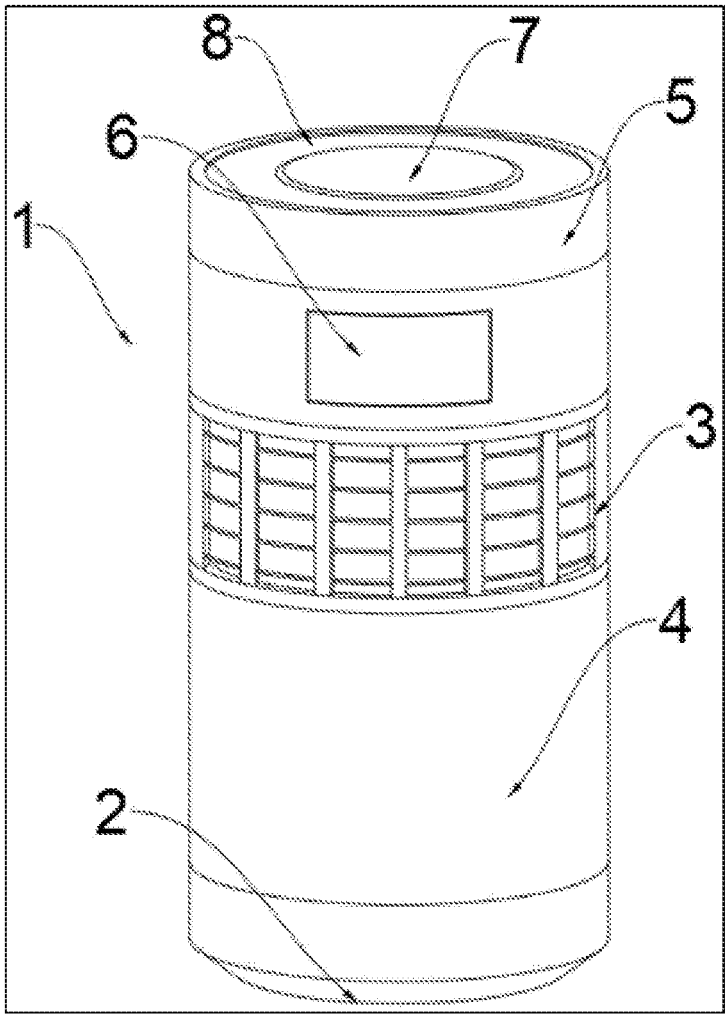
FIG. 1 is a structural diagram of a display lamp in the related art.

Reference numerals: 10—casing, 11—casing bottom surface, 12—casing side surface, 13—light-transmitting port, 14—light source bearing portion, 15—light source, 20—casing cover, 21—outer peripheral cover portion, 22—inner peripheral cover portion, 23—light-transmitting gap, 24—connecting rib, 241—concave portion extending surface, 242—concave portion bottom surface, 25—ventilation plate, 26—covering member, 27—button, 28—button connecting rib, 29—supporting shaft, 30—first reinforcement rib, 31—second reinforcement rib, 40—cover portion, 41—light-transmitting strip, C—light.

DETAILED DESCRIPTION OF EMBODIMENTS

The light-emitting device of the present disclosure may be specifically applied to an ion releaser with a light-emitting display function. At the same time, the light-emitting device may also be applied to an air purifier, an air disinfection device, a vehicle-mounted air purifier, an air conditioning device with a light-emitting display function, or a device in another field with a light-emitting display function. In an embodiment, the light-emitting device of the present disclosure is applied to an ion releaser, and the present disclosure will be described by taking the ion releaser having the light-emitting device as a specific embodiment.

It should be noted that the ion releaser is a portable air treatment device, which may effectively remove odors, sterilize bacteria, increase humidity, and perform other treatments on air outside the device by generating water ions and releasing the water ions outside the device. In addition, when the ion releaser is operating, in order to indicate an operating status (such as an amount of electricity, error report, etc.) information to the user and to increase aesthetics, the ion releaser is provided with a light-emitting structure having functions such as changing brightness, hue or flickering frequency of light, etc.

Figure 2:
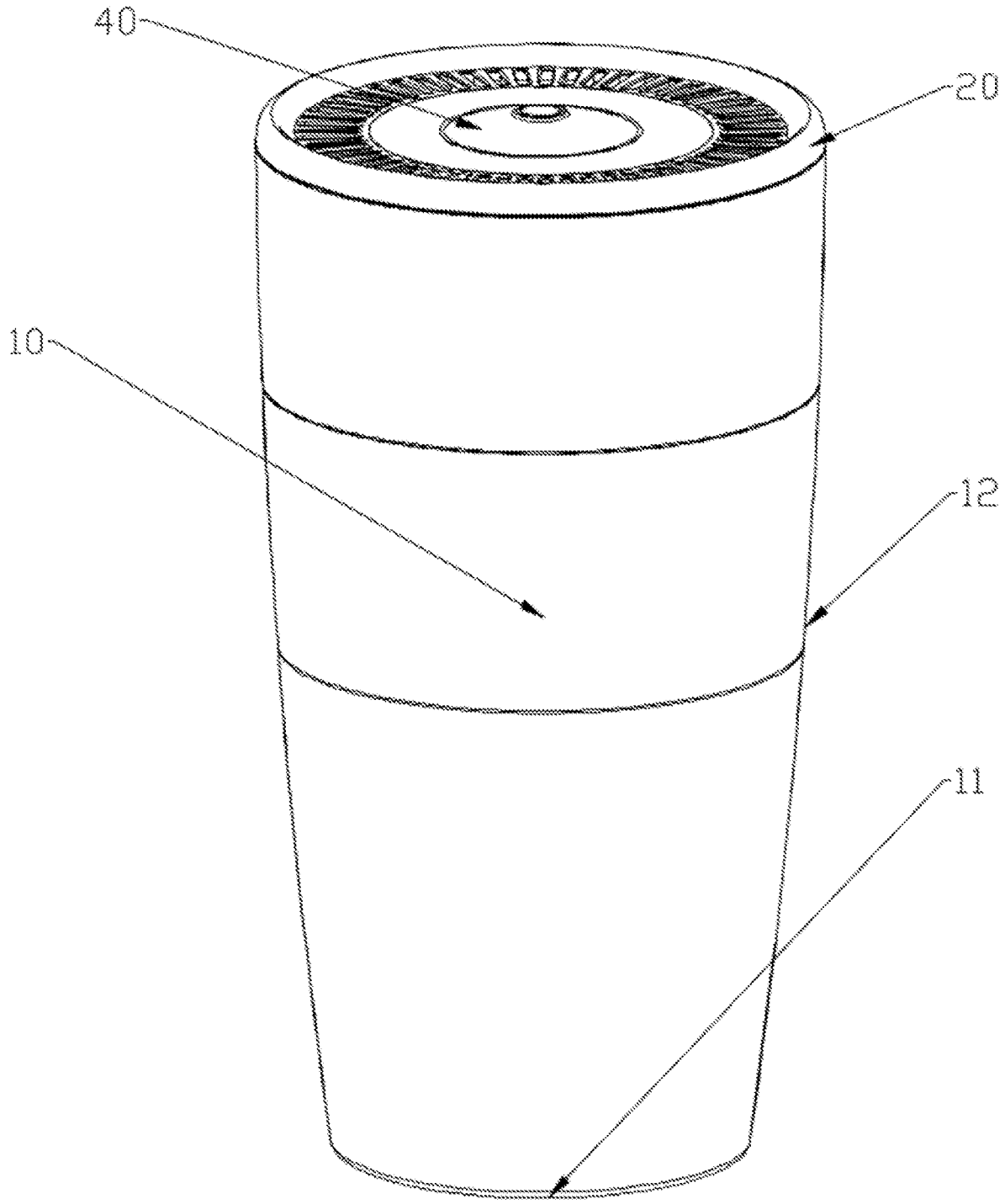
FIG. 2 is an overall structural diagram of a light-emitting device according to an embodiment of the present disclosure.
Figure 3:
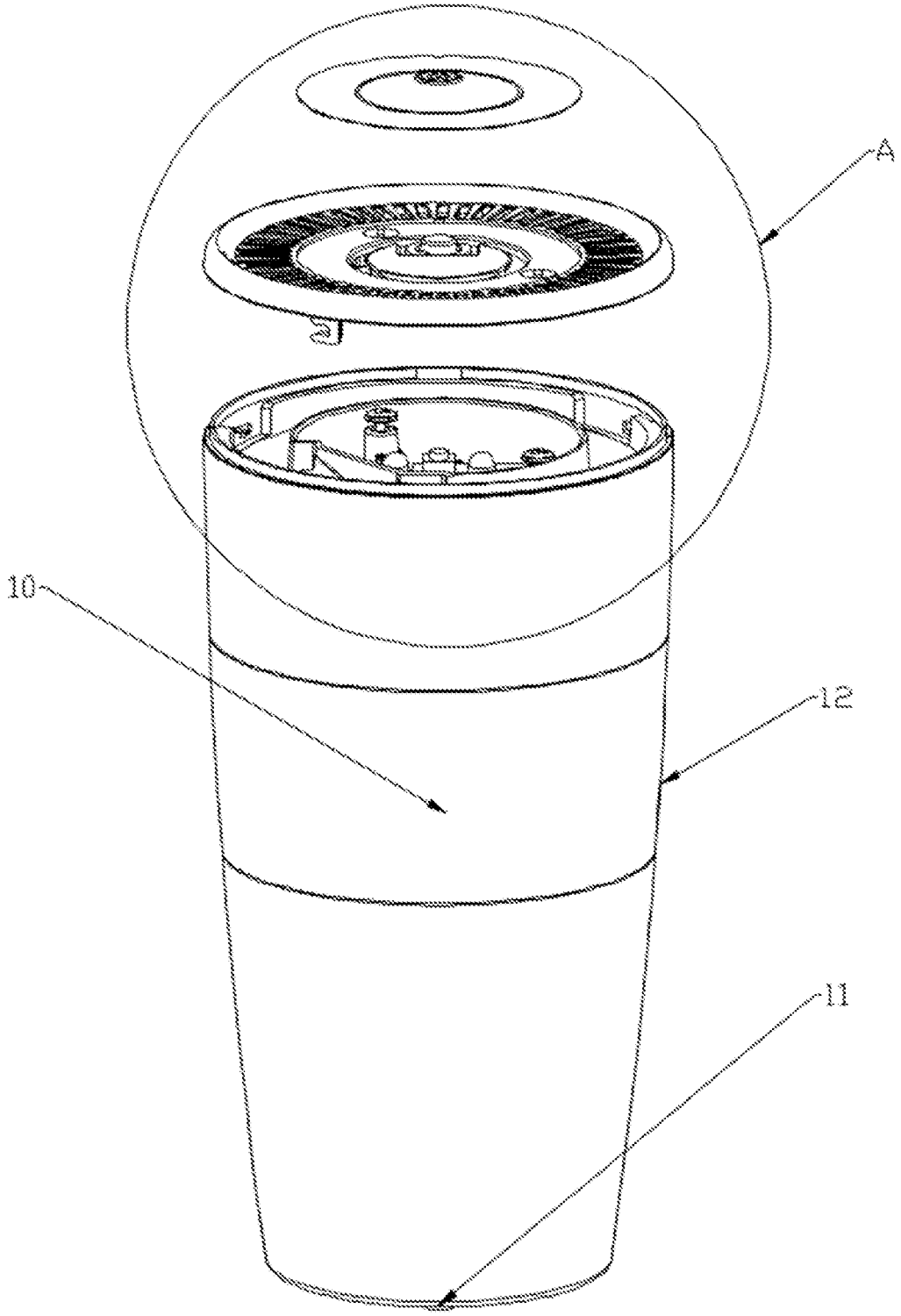
FIG. 3 is an exploded diagram of a partial structure of a light-emitting device according to an embodiment of the present disclosure.
Figure 4:
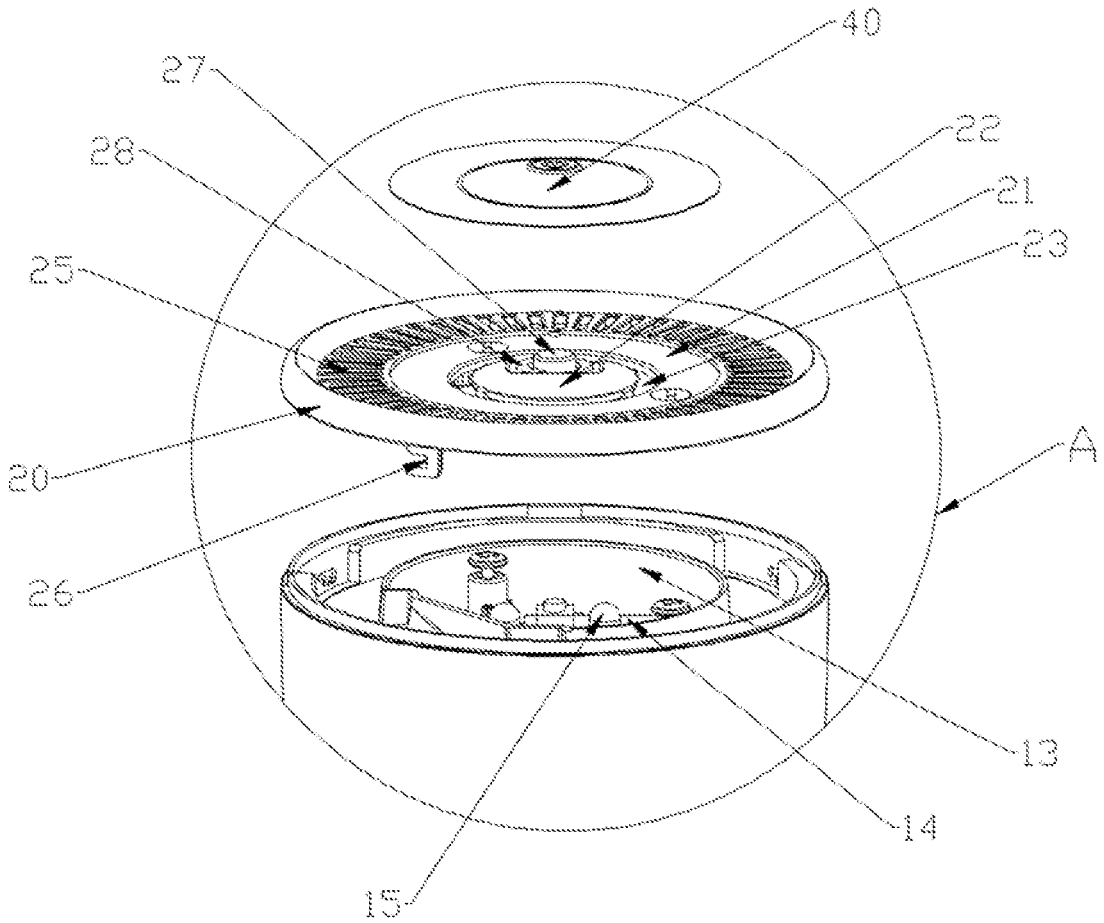
FIG. 4 is a partial enlarged view A of FIG. 3.

The present disclosure aims to provide a light-emitting device. Referring to FIG. 2, FIG. 3 and FIG. 4 simultaneously, the light-emitting device includes a casing 10, a casing cover 20 and a cover portion 40.

Specifically, the casing 10 forms a shell of an ion releaser. The casing is cylindrical, and has a cross-sectional area gradually decreasing from top to bottom. The casing 10 is provided with: a casing bottom surface 11, a casing side surface 12, a light-transmitting port 13, and a light source bearing portion 14.

The casing bottom surface 11 is a bottom surface of the cylindrical shell. The casing bottom surface is generally a plane facing vertically downwards and used for a stable placement of the ion releaser. The casing bottom surface 11 is also provided with a drain hole (not shown in the drawing) for discharging unnecessary moisture inside the casing 10.

The casing side surface 12 is a curved circumferential side surface that forms the cylindrical shell. The casing side surface 12 is provided with an air suction port (not shown in the drawing) for allowing air outside the ion releaser to enter into the casing. One end of the casing side surface 12 is connected to the casing bottom surface 11, and a semi-enclosed structure is formed by combining the casing side surface with the casing bottom 11. The other end of the casing side surface 12 forms an opening, that is, a subsequently described light-transmitting port 13.

The light-transmitting port 13 is an opening at a top portion of the casing side surface 12, and the light-transmitting port is used to transmit light emitted from the inside of the casing 10 to the outside of the casing 10. The light-transmitting port 13 is located at the top of the cylindrical shell, and is generally an opening facing vertically upward.

The light source bearing portion 14 is a planar structure disposed inside the casing 10 and facing the light-transmitting port 13. The light source bearing portion 14 is provided with a light source 15.

The light source 15, which provides a light-emitting function of the ion releaser, is disposed on the light source bearing portion 14 and located below the light-transmitting port 13. In the embodiment, the light source emits light vertically upward, that is, the light emitted from the light source 15 passes through the light-transmitting port 13 and is then emitted to the outside of the casing 10. In the embodiment, the light sources 15 are three LED light-emitting diode lamp beads (hereinafter referred to as lamp beads), and the three lamp beads are horizontally disposed on the light source bearing portion 14 and arranged in a ring shape. The light source 15 may also be set to other numbers of lamp beads or may also be set as other lighting items.

Further, the casing cover 20 will be described with reference to FIG. 4 to FIG. 8.

Figure 5:
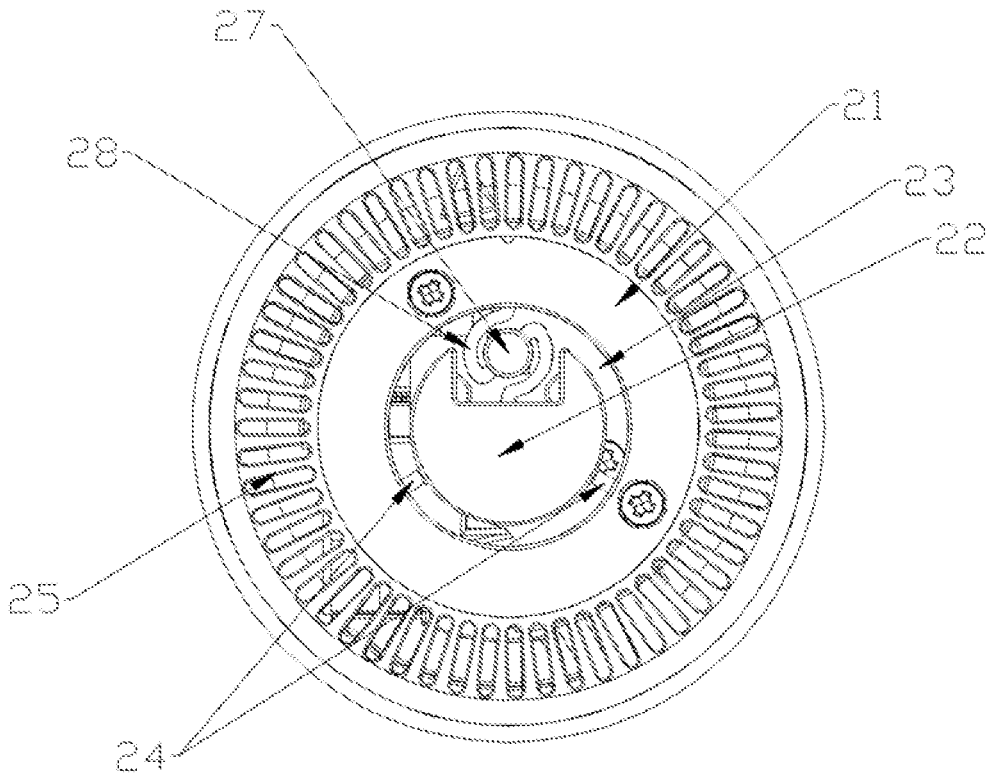
FIG. 5 is a top structural diagram of a casing cover according to an embodiment of the present disclosure.

Referring to FIG. 4 and FIG. 5, the casing cover 20 is a cover for detachably covering the light-transmitting port 13. The casing cover 20 has a circular shape, and completely covers the light-transmitting port 13 in a closed state. The casing cover 20 is provided with: an outer peripheral cover portion 21, an inner peripheral cover portion 22, a light-transmitting gap 23, a connecting rib 24, a ventilation plate 25, a covering member 26, a button 27, a button connecting rib 28, a supporting shaft 29, a first reinforcement rib 30 and a second reinforcement rib 31.

The outer peripheral cover portion 21, which is disposed in the light-transmitting port 13, is used to block a part of light emitted from the light source. Preferably, the outer peripheral cover portion 21 is ring-shaped. The outer peripheral cover portion 21 is provided with screw openings (two in the embodiment) for screws to insert and install so as to fix the casing cover 20 on the casing 10. Here, a surface of the outer peripheral cover portion 21 facing a direction of the light source is defined as a bottom surface of the outer peripheral cover portion 21.

The inner peripheral cover portion 22, which is disposed in the light-transmitting port 13, is located on an inner side of the outer peripheral cover portion 21, and is also located at a center position of the casing cover 20. The inner peripheral cover portion is used to block a part of the light emitted from the light source. The inner peripheral cover portion 22 is designed to have a partially cut-out circular shape. The inner peripheral cover portion 22 and the outer peripheral cover portion 21 are located on the same plane. Here, a surface of the inner peripheral cover portion 22 facing the direction of the light source is defined as a bottom surface of the inner peripheral cover portion 22.

The light-transmitting gap 23 is formed by spacing the outer peripheral cover portion 21 with the inner peripheral cover portion 22. The light-transmitting gap 23, which is substantially ring-shaped, is used to allow the light emitted from the light source 15 to pass through and then be diverged to the outside of the casing 10.

Figure 6:
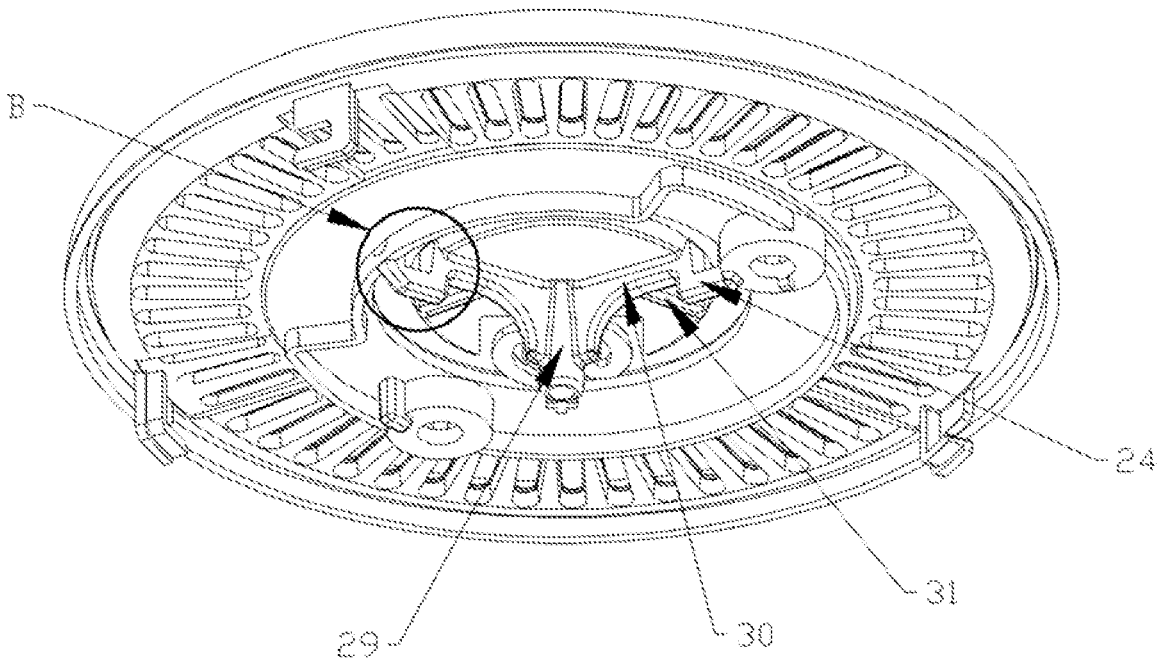
FIG. 6 is a bottom structural diagram of a casing cover according to an embodiment of the present disclosure.

Referring to FIG. 5 and FIG. 6. The connecting rib 24, which is a connecting structure that spans the light-transmitting gap 23, is used to connect the inner peripheral cover portion 22 with the outer peripheral cover portion 21. At the same time, the connecting rib 24 provides a support for the inner peripheral cover portion 22. In the embodiment, there are two connecting ribs. Specifically, the connecting rib 24 is disposed below the inner peripheral cover portion 22 and the outer peripheral cover portion 21. One end of the connecting rib 24 is connected to the bottom surface of the inner peripheral cover portion 22, and the other end of the connecting rib 24 is connected to the bottom surface of the outer peripheral cover portion 21. Considering not blocking the light emitted from below, a projection of the connecting rib 24 on the light-transmitting gap 23 is preferably set to be smaller. The connecting rib 24 is not disposed vertically directly above the light source 15, that is, the light source 15 is staggered with the connecting rib 24. The connecting rib 24 is provided with: a concave portion. Further, the concave portion will be described with reference to FIG. 7. The concave portion is a concave hollow space formed by bending the connecting rib 24 toward the inside of the casing. The concave portion is provided with: concave portion extending surfaces 241 and a concave portion bottom surface 242.

The concave portion extending surfaces 241 are surfaces respectively extending downward from two sides of the light-transmitting gap 23, that is, from an outer peripheral edge of the inner peripheral cover portion 22 and an inner peripheral edge of the outer peripheral cover portion 21. Each concave portion is provided with two concave portion extending surfaces 241, and the two concave portion extending surfaces 241 are disposed opposite to each other. A distance between the two concave portion extending surfaces 241 is set to be greater than or equal to a width of the light-transmitting gap 23. It should be noted that the "equal to" mentioned here does not necessarily mean completely equal, and there may be a slight increase or decrease within an error tolerance considering factors such as product manufacturing process and the like. In addition, a length of the concave portion extending surface 241 in a vertical direction is preferably set to be larger. The concave portion extending surface 241 may also be set to be an arc surface, or a surface formed by a combination of a plurality of flat surfaces or arc surfaces. In addition, the concave portion extending surfaces 241 may also extend from the bottom surface of the inner peripheral cover portion 22 and the bottom surface of the outer peripheral cover portion 21.

The concave portion bottom surface 242 is a plane formed by connecting an end of one concave portion extending surface 241 on a side close to the light source 15 with an end of the other concave portion extending surface 241 on a side close to the light source. An area of the concave portion bottom surface 242 is preferably set to be greater than or equal to the width of the light-transmitting gap 23. The concave portion bottom surface 242 may also be an arc surface, or a surface formed by a combination of a plurality of flat surfaces or arc surfaces. The concave portion bottom surface 242 and the two concave portion extending surfaces 241 together form the concave portion.

Referring back to FIG. 4, FIG. 5 and FIG. 6, other components of the casing cover 20 will continue to be described. The ventilation plate 25, which is disposed around the outer peripheral cover portion 21, is located at an outermost side of the casing cover 20. The ventilation plate 25 is provided with a number of air discharge ports, the air discharge ports are strip-shaped and arranged to form a grille-ring structure, so that the air inside the casing 10 is mixed with ions and then discharged to the outside of the casing 10.

The covering member 26, which is located at an outermost peripheral side of the casing cover 20, is a component used for covering and fixing the casing cover 20 to the casing 10. In the embodiment, the covering member 26 is a hook-shaped engaging structure. In addition, the covering member 26 may have a structure that may achieve a fixing function, such as spiral-shaped.

The button 27, which is located between the outer peripheral cover portion 21 and the inner peripheral cover portion 22, is used for an user to achieve a control function of the ion releaser by pressing. The control function includes starting the device, closing the device and the like. In the embodiment, the button 27 and a light-touch key switch below the button 27 combines to constitute a switch function of the ion releaser, that is, the switch function will be closed and turned on when a pressure is applied in an operating direction (vertically downward) of the switch in a condition meeting an operating force, and the switch will be turned off when the pressure is removed.

The button connecting rib 28 is used to connect the button with the inner peripheral cover portion 22 and/or the outer peripheral cover portion 21 so as to fix the button on the inner peripheral cover portion 22. At the same time, through a tough deformation of the button connecting rib 28, a change and a recovery of a position of the button when being pressed may be achieved. Therefore, a material of the button connecting rib 28 is preferably tough. In the embodiment of the present disclosure, there are two button connecting ribs 28. One end of one button connecting rib 28 is connected to the edge of the inner peripheral cover portion 22, and the other end of one button connecting rib 28 is connected to the button 27. One end of the other button connecting rib 28 is connected to the edge of the outer peripheral cover portion 21, and the other end of the other button connecting rib 28 is connected to the button 27.

The supporting shaft 29, which is used to support the inner peripheral cover portion 22, has a columnar structure extending in a direction from the bottom surface of the inner peripheral cover portion 22 to the light source 15. That is, one end of the supporting shaft 29 is disposed on the bottom surface of the inner peripheral cover portion 22, and the other end of the supporting shaft 29 and the light source carrying portion 14 are in contact and resisting with each other when the casing cover 20 is closed so as to play a supporting role. Preferably, the supporting shaft 29 is disposed at a center position of the inner peripheral cover portion 22.

Figure 7:
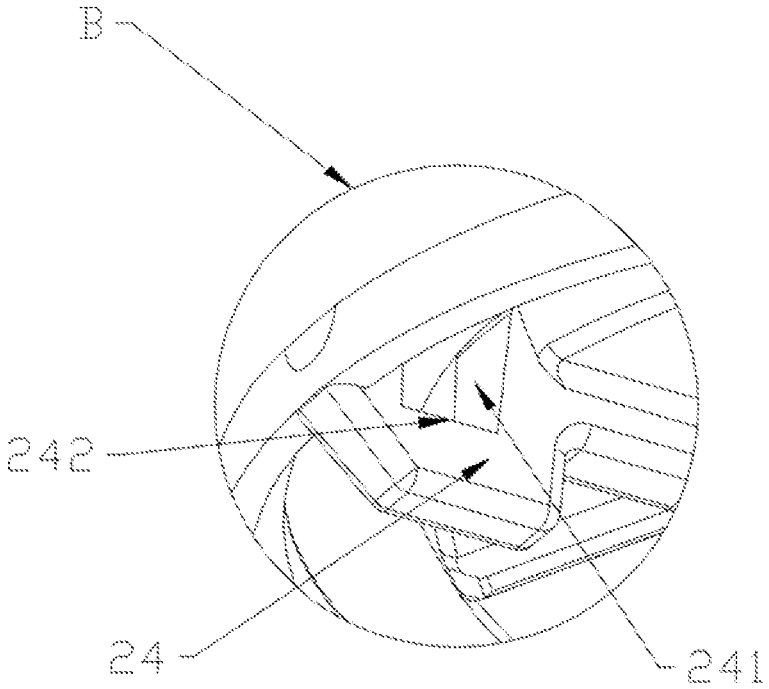
FIG. 7 is a partial enlarged view A of FIG. 6.
Figure 8:
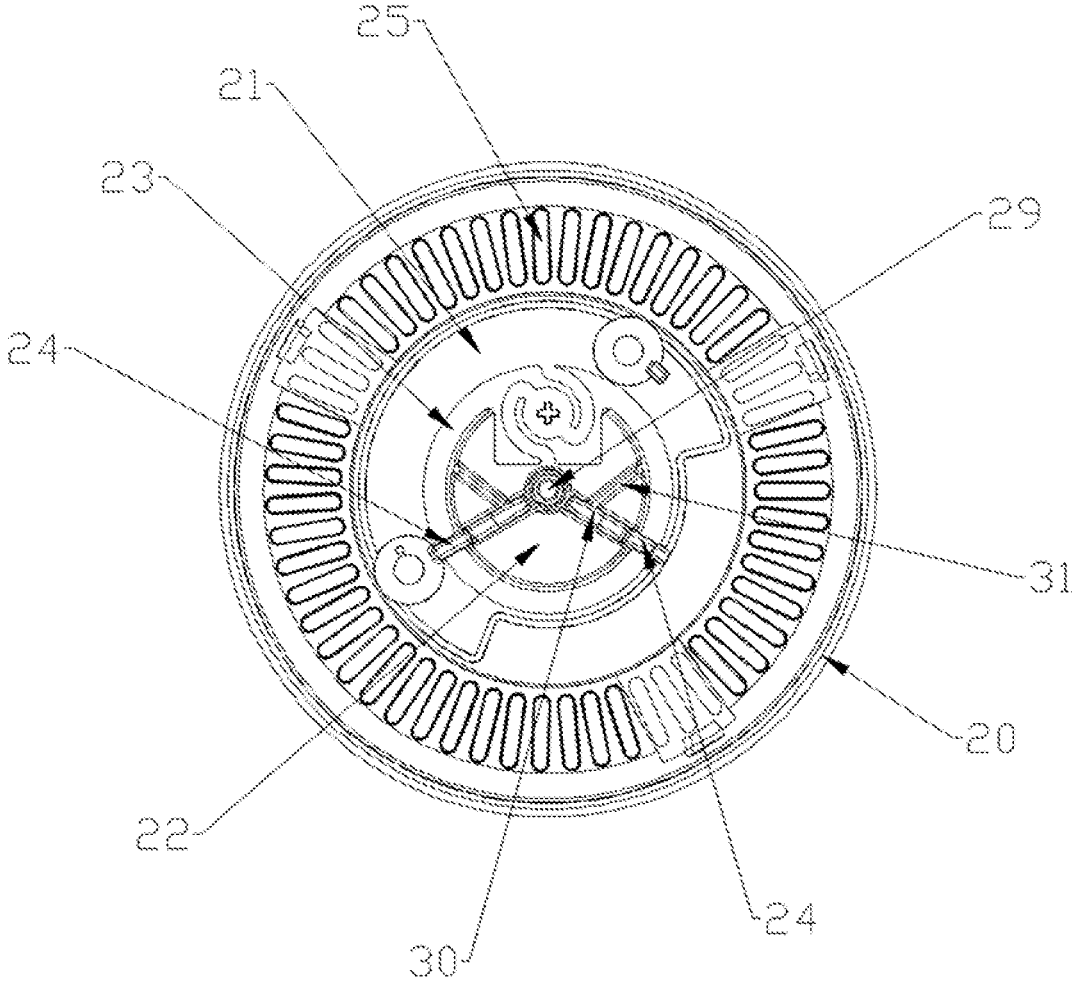
FIG. 8 is a bottom structural diagram of a casing cover according to an embodiment of the present disclosure.

Referring to FIG. 6 and FIG. 7 in combination, the first reinforcement rib 30 is a rib protruding in the direction from the bottom surface of the inner peripheral cover portion 22 to the light source 15. Two ends of the first reinforcement rib 30 are respectively connected to the supporting shaft 29 and the connecting rib 24. In the embodiment, there are two first reinforcement ribs 30. Preferably, the first reinforcement rib 30 has a shape that gradually expands downward in a direction close to the supporting shaft 29, that is, a vertical extension length of an end portion of the first reinforcement rib 30 close to the supporting shaft 29 is greater than a vertical extension length of an end portion of the first reinforcement rib 30 close to the connecting rib 24. In the embodiment of the present disclosure, the first reinforcement rib 30 and the connecting rib 24 are integrally formed.

The second reinforcement rib 31 is a rib protruding in the direction from the bottom surface of the inner peripheral cover portion 22 to the light source, and two ends of the second reinforcement rib 30 are respectively connected to the first reinforcement rib 30 and the peripheral edge of the inner peripheral cover portion 22. That is, the second reinforcement rib 31 intersects with the first reinforcement rib 30.

Figure 9:
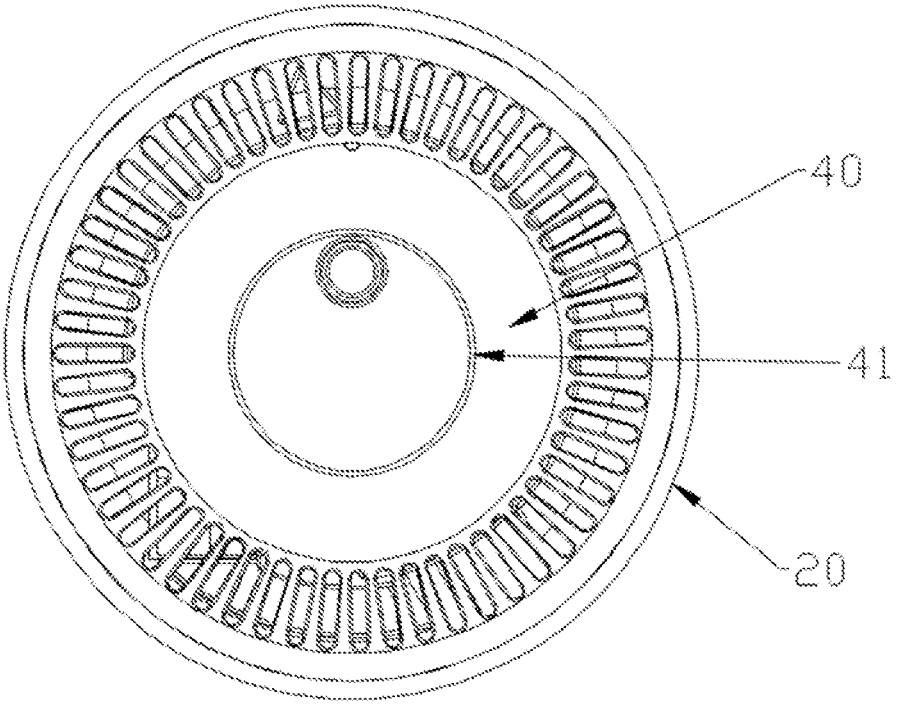
FIG. 9 is a structural diagram of a cover portion according to an embodiment of the present disclosure.

Further, the cover portion 40 will be described with reference to FIG. 9 and FIG. 4 in combination.

The cover portion 40, which is located above the casing cover 20, is used to cover a part of the casing cover 20, so as to prevent the user from directly observing the outer peripheral cover portion 21, the inner peripheral cover portion 22, the button 27 and other internal parts, thus improving an aesthetics of a product. At the same time, the cover portion 40 is used for a formation of a display light path. In the embodiment, the cover portion 40 is a circular adhesive-type back-dry adhesive paper whose diameter is equal to an outer peripheral diameter of the outer peripheral cover portion 21, that is, the cover portion 40 just completely covers the outer peripheral cover portion 21 and all components enclosed by the outer peripheral cover portion 21. The cover portion 40 may also be a plate-shaped structural component or the like that may achieve a cover function. Generally, the cover portion 40 may be printed with an icon corresponding to a position of the button, and a pattern such as a device model, a brand logo, a decorative pattern, or the like. The cover portion 40 is provided with: a light-transmitting strip 41.

The light-transmitting strip 41, which is disposed on the cover portion 40 corresponding to a position of the light-transmitting gap 23 of the casing cover 20, is made of a light-transmitting material. The light-transmitting strip 41 is designed to be ring-shaped so that transmitted light may form a ring-shaped light path display. In a vertical top view of the casing cover 20, the light source is located in an inner position surrounded by the ring-shaped light-transmitting strip 41. In the embodiment of the present disclosure, the light-transmitting strip 41 is a ring-shaped light-transmitting material integrally formed with the adhesive paper. It should be noted that, the light-transmitting strip 41 may also be left blank.

A structure of the light-emitting device according to the embodiment of the present disclosure has been described above.

Figure 10:
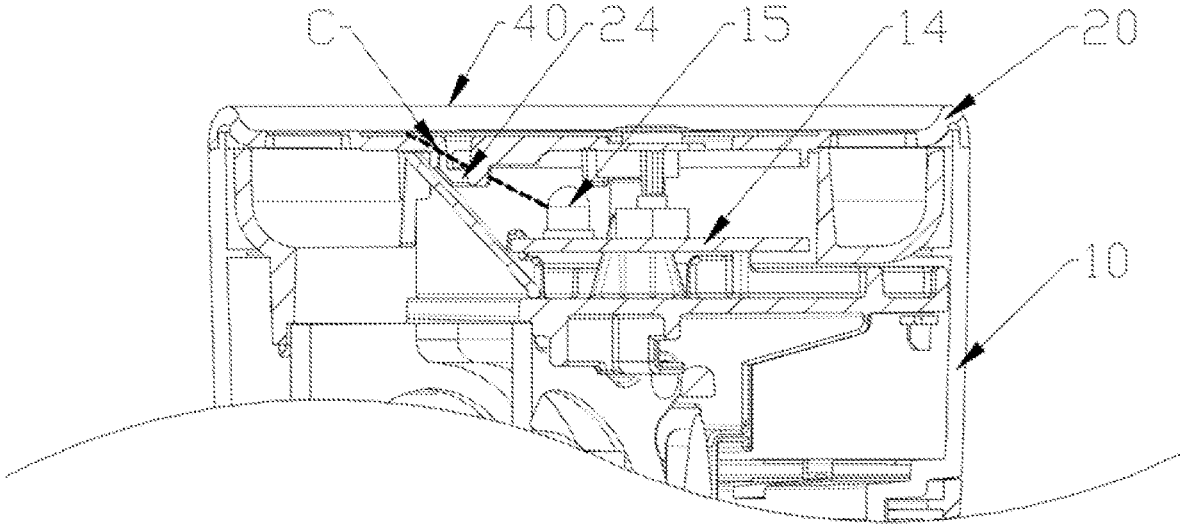
FIG. 10 is a working principle diagram of a light-emitting device according to an embodiment of the present disclosure.

A principle of forming the light path of the light-emitting device according to the embodiment of the present disclosure will be described below with reference to FIG. 10 and FIG. 3.

The light sources 15 (that is, three lamp beads) located inside the casing 10 are powered on and emit light. The light is diverged to the surrounding from the light source 15 and is irradiated onto the casing cover 20. At this time, due to a block of light by the outer peripheral cover portion 21 and the inner peripheral cover portion 22 of the casing cover 20, the light may not pass through. At the same time, since the light-transmitting gap 23 is provided between the outer peripheral cover portion 21 and the inner peripheral cover portion 22, the light may pass through the light-transmitting gap 23. In addition, since the button 27 and the button connecting rib 28 are further provided between the outer peripheral cover portion 21 and the inner peripheral cover portion 22, the light may also pass through a gap between the button and the button connecting rib. In view of the above-mentioned situation, the cover portion 40 (i.e., an adhesive-type adhesive paper) provided above the casing cover 20 is to form a complete ring-shaped light path on the casing cover 20. Specifically, according to a shape of the light-transmitting gap 23, the cover portion 40 is provided with a light-transmitting strip 41 having a light-transmitting function at a position corresponding to the light-transmitting gap 23, and parts of the cover portion 40 other than the light-transmitting strip 41 are made of an opaque material. Therefore, the above-mentioned light passing through a vicinity of the button 27 and the button connecting rib 28 may be blocked by the opaque material of the cover portion 40, and thus may not be emitted to the outside of the ion releaser. In other words, only the light passing through the light-transmitting strip 41 of the cover portion 40 may be emitted to the outside of the light-emitting device, and the light may finally achieve a ring-shaped light path display on the cover portion 40.

Next, a function and an effect of a related structure of the light-emitting device according to the embodiment of the present disclosure will be described below with reference to FIG. 10.

The concave portion of the connecting rib 24 is bent downward at the light-transmitting gap 23 to form the concaved hollow space. Therefore, the light emitted from the light source 15 may pass through the concaved hollow space obliquely, and may thus be irradiated onto a transparent material of the cover portion 40 above the concave portion (in a light path as shown in C). Therefore, a dark portion of the ring-shaped light path (that is, the vacant path is vacant) caused by an upper portion of the connecting rib 24 blocked by the connecting rib and not being irradiated by the light may be prevented, thereby preventing the user from feeling unpleasant or mistakenly believing that the product is defective. At the same time, the connecting rib 24 is used to connect the outer peripheral cover portion 21 with the inner peripheral cover portion 22, preventing the inner peripheral cover portion 22 from being detached without any support, achieving an integration of the outer peripheral cover portion 21 and the inner peripheral cover portion 22, thus facilitating the user to assemble and disassemble the casing cover 20.

The distance between the two concave portion extending surfaces 241 may be set to be greater than or equal to the width of the light-transmitting gap 23, which may expand a range of the light irradiated to the light-transmitting gap 23, that is, reduce a block of the concave portion extending surface 241 against the light that may be irradiated to the light-transmitting gap 23.

The lamp bead serving as the light source 15 is staggered with the connecting rib 24, that is, the lamp bead is not disposed vertically directly below the connecting rib 24, so that more light may pass through the concave portion of the connecting rib 24 obliquely so as to be irradiated onto the transparent material of the cover portion 40 above the concave portion. Assuming that the lamp bead is disposed vertically directly below the connecting rib 24, the connecting rib 24 located directly above the lamp bead will block the light emitted from directly below the lamp bead. Although the light of the lamp bead located at other positions may pass through the concave portion of the connecting rib 24 obliquely, the light irradiated directly above the connecting rib 24 may not be sufficient, resulting in a dark light path above the connecting rib 24, thereby causing a shortage of the light path. Therefore, by staggering the lamp bead with the connecting rib 24, the light irradiated above the connecting rib is ensured to be sufficient, thereby preventing the user from feeling unpleasant or mistakenly believing that the product is defective.

The supporting shaft 29 is used to strengthen an anti-pressure ability of the inner peripheral cover portion 22. Since the inner peripheral cover portion 22 is provided with the button for the user to press, every time the user presses the button, a downward force is generated on the inner peripheral cover portion 22 connected to the button. Therefore, by abutting supporting shaft 29 against the light source bearing portion 14, a pressure on the inner peripheral cover portion 22 may be dispersed to the light source bearing portion 14, preventing a damage to the inner peripheral cover portion 22 or the connecting rib 24 when subjected to a large force.

Similarly, the first reinforcement rib 30 and the second reinforcement rib 31 are also used to enhance a compressive strength of the inner peripheral cover portion 22, that is, locally increase a thickness of the inner peripheral cover portion 22 so as to enhance the compressive strength of the inner peripheral cover portion 22. A vertical length of a connecting portion between the first reinforcement rib 30 and the supporting shaft 29 is set to be greater than a vertical length of a connecting portion between the first reinforcement rib 30 and the connecting rib 24, that is, a contact area between the first reinforcement rib 30 and the supporting shaft 29 increases. When a force is applied to the inner peripheral cover portion 22, a pressure may be more sufficiently dispersed to the supporting shaft 29 and then transferred to the light source bearing portion 14 for dispersion.

The above-mentioned embodiments only represent several embodiments of the present disclosure whose descriptions are specific and detailed. However, they should not be construed as a limitation on the scope of the present disclosure. It should be noted that, those skilled in the art may make various modifications and improvements without departing from the concept of the present disclosure, and these modifications and improvements should all fall within the scope of protection of the present disclosure.

What is claimed is:

1. A light-emitting device, comprising:

a casing provided with a light-transmitting port;

a light source disposed inside the casing; and a casing cover covering the light source, wherein the casing cover is configured to be disposed in the light-transmitting port to cover the casing;

wherein the casing cover comprises:

an outer peripheral cover portion provided with an opening;

an inner peripheral cover portion located in the opening, wherein a light-transmitting gap is formed by spacing the inner peripheral cover portion with the outer peripheral cover portion; and a connecting rib configured to span the light-transmitting gap, and connect the outer peripheral cover portion with the inner peripheral cover portion;

wherein, the connecting rib includes a concave portion extending toward an inside of the casing and configured to prevent at least a portion of light emitted by the light source from being blocked by the connecting rib.

2. The light-emitting device according to claim 1, wherein:

the light source is a plurality of lamp beads, and the lamp beads are located below the connecting rib and staggered with the connecting rib.

3. The light-emitting device according to claim 1, the concave portion further comprising:

two concave portion extending surfaces opposite to each other and configured to respectively extend from two side edges of the light-transmitting gap to the light source, and a concave portion bottom surface close to the light source and configured to connect the two concave portion extending surfaces.

4. The light-emitting device according to claim 3, wherein:

a distance between the concave portion extending surfaces is greater than or equal to a width of the light-transmitting gap.

5. The light-emitting device according to claim 1, the casing cover further comprising:

a supporting shaft disposed inside the casing, wherein one end of the supporting shaft is fixed on the inner peripheral cover portion, and the other end of the supporting shaft abuts against a casing interior support.

6. The light-emitting device according to claim 5, the casing cover further comprising:

a first reinforcement rib protruding in a direction from a bottom surface of the inner peripheral cover portion to the light source, wherein the first reinforcement rib is configured to connect the connecting rib with the supporting shaft.

7. The light-emitting device according to claim 6, the casing cover further comprising:

a second reinforcement rib protruding in the direction from the bottom surface of the inner peripheral cover portion to the light source, wherein the second reinforcement rib is configured to intersect with the first reinforcement rib.

* * * * *